United States Patent [19]

Gerch

[11] 4,420,068

[45] Dec. 13, 1983

[54] COMBINATION CARRYING CASE AND DETACHABLE GARMENT CARRIER

[75] Inventor: Edward L. Gerch, Chicago, Ill.

[73] Assignee: Kingport, Ltd., Evanston, Ill.

[21] Appl. No.: 328,130

[22] Filed: Dec. 7, 1981

[51] Int. Cl.[3] ..... A45C 3/00

[52] U.S. Cl. ..... 190/102; 190/108; 190/110; 190/111

[58] Field of Search ..... 190/43, 52, 60

[56] References Cited

U.S. PATENT DOCUMENTS

| | | | |
|---|---|---|---|
| 3,244,261 | 4/1966 | Herz | 190/43 |
| 3,295,644 | 1/1967 | Furuya | 190/43 |
| 3,433,335 | 3/1969 | Spitz | 190/43 |
| 4,206,835 | 6/1980 | Shapiro | 190/60 |
| 4,301,898 | 11/1981 | Plough et al. | 190/60 |
| 4,303,184 | 12/1981 | Kloth | 190/52 X |

*Primary Examiner*—Donald F. Norton

*Attorney, Agent, or Firm*—Kegan, Kegan & Berkman

[57] ABSTRACT

A soft-sided carrying case or travel bag having individual business document and paraphenalia storage compartments, an umbrella storage retainer, and a compartment suitable for storing clothes is combinable with an improved garment bag which may be folded in half and retained in that position by a neck and collar configuration on the top of the bag. A strap structure on the garment bag is selectably attachable to the travel bag carrying handle, thus avoiding the need for any specialized hooks, rings, slips, buckles or the like on the carrying case.

6 Claims, 8 Drawing Figures

COMBINATION CARRYING CASE AND DETACHABLE GARMENT CARRIER

BACKGROUND OF THE INVENTION

This invention relates generally to luggage and travelware, and more particularly to an improved carrying case which is combinable with a new foldable garment bag carried on the exterior of the carrying case.

While the advantages of soft-sided luggage and separate compartments in soft-sided luggage for larger outerwear garments such as suits are known and described in U.S. Pat. No. 4,261,448, and while the use of separate garment bags and carrying cases in combination has also been disclosed in U.S. Pat. No. 4,206,835, restrictions placed upon luggage size, particularly in airplanes, and the general desire to make personal accessory containers more compact, has created a need for new and improved luggage and travelware.

In applicant's pending application Ser. No. 211,424, a combination tote bag-garment bag assembly is shown wherein access to the inner tote bag is not hindered by attaching the garment bag partially around the outside of the tote bag.

While the above-described luggage performs its intended purpose, a business person carrying documents and/or office equipment and accessories has heretofor been required to carry a separate attache case in addition to a carrying case (sized to fit underneath an airplane seat) and a garment bag which may be hung in a closet compartment of an airplane or other means of conveyance. Also, combination carrying cases and garment bags heretofor known have been combinable only with the aid of additional rings, hooks, buckles, etc. attached to the carrying case. It is therefore desirable that a garment bag combinable with a carrying case be adapted for attachment to the case without modification of the same.

It is therefore an object of the invention, generally stated, to provide a new and improved garment bag which is combinable with a carrying case including both facilities for storing business materials and clothing materials.

A further object of the present invention is the provision of an improved garment bag which may be maintained in a half-folded condition and combined in such condition with a carrying case.

SUMMARY OF THE INVENTION

The invention is directed to a carrying case of the type wherein flexible material is configured to define a plurality of compartments with each compartment having an opening and an improvement wherein a second compartment positioned adjacent a middle compartment includes a filling separator for segregating business or other documents positioned in the case. The carrying case includes a third compartment opposite the central compartment from the second compartment which includes a plurality of diverse sized storage compartments and an umbrella storage compartment positioned in one of said second and third compartments adapted for retaining a collapsible umbrella therein.

The invention is further directed to a garment bag of the type having opposed elongate panels joined along their periphery with one of the panels having an access opening down the center thereof with preferably a slide fastener mounted thereon. The garment bag includes an improvement being an elongate fastener positioned adjacent one of the ends of the elongate panels for fastening the garment bag to an external member. A collar or strap is attached to the other end of the garment bag defining a neck through which the fastener is insertable prior to fastening the garment bag to an external member.

The invention is further directed to a combination of the garment bag and carrier case described above wherein the bag is attachable to the case without special modifications being made to the case.

BRIEF DESCRIPTION OF THE DRAWINGS

The features of the present invention, which are believed to be novel, are set forth with particularity in the appended claims. The invention may best be understood from the following detailed description of a currently-preferred embodiment thereof taken in conjunction with the accompanying drawings wherein:

DETAILED DESCRIPTION OF THE PREFERRED EMBODIMENT

Figure 1:
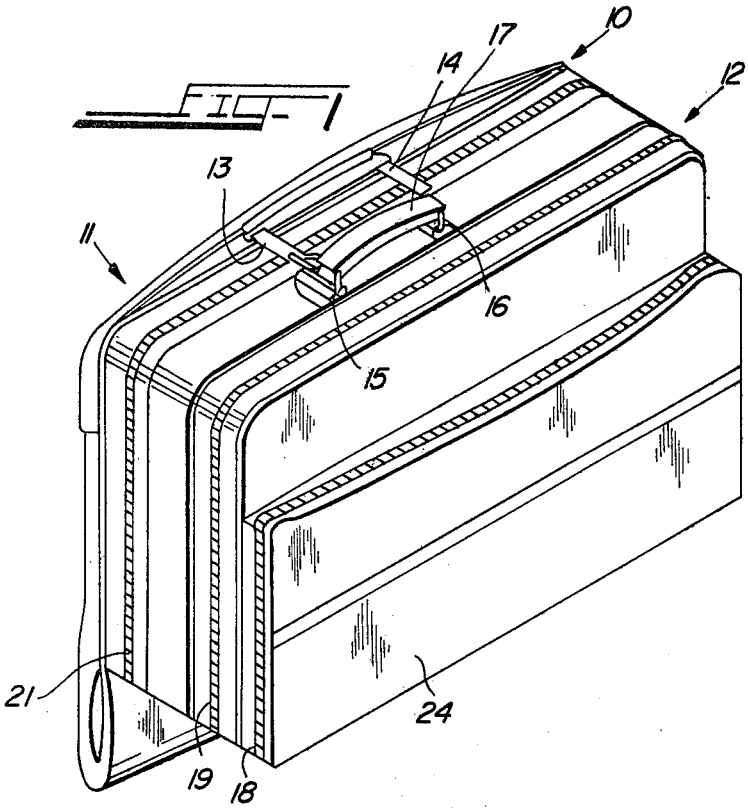
FIG. 1 is a perspective view of the combination garment bag-improved carrying case of the present invention.
Figure 2:
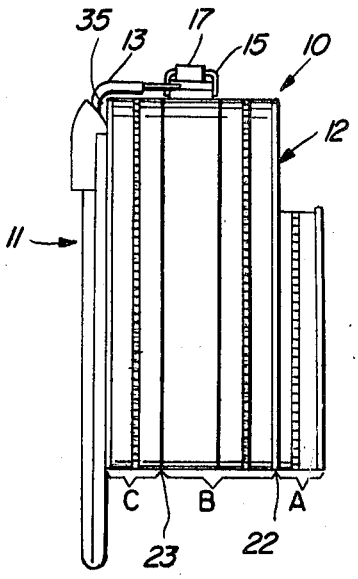
FIG. 2 is an end elevational view of the combination bag-case shown in FIG. 1.

Referring to FIGS. 1 and 2, the combination carrying case-garment bag of the present invention is indicated generally at 10 and includes a foldable garment bag 11 which is releasably fastened to a soft-sided multi-compartment carrying case 12. Foldable garment bag 11 is combinable with carrying case 12 by means of dual snap fasteners 13, 14 mounted adjacent the top of bag 11 which fasten on opposing hinge members 15, 16 of carrying case handle 17 affixed to the top of the case. Since the garment carrier fastens directly to the carrying case handle, no other or additional fastening members such as buckles, rings, snaps, etc. need be affixed to the carrying case 12.

One aspect of the present invention is the improved carrying case 12 which includes in the preferred embodiment a three-compartment structure with the spacing and arrangement of the various compartments divided as shown in FIG. 2 as compartments A, B and C. Compartment A is a business paraphenalia compartment; compartment B is a largely hollow clothing storage compartment, and compartment C is a document carrier having an umbrella retaining pouch therein. In the preferred embodiment, compartment A is slightly shorter in height than compartment B or C, as pencils, pens, paper clips, note pads, etc. do not take up as much space as clothing or document files. All three compartments have individual openings which extend over the opposing sides and top of the compartment side panels with slide fasteners 18, 19 and 21, respectively, being a preferred means of selectively closing compartments A, B and C. For ease of assembly, economy, and for greater rigidity, compartment B largely shares a common dividing wall 22 with compartment A and shares an opposing common wall 23 with compartment C.

Figure 3:
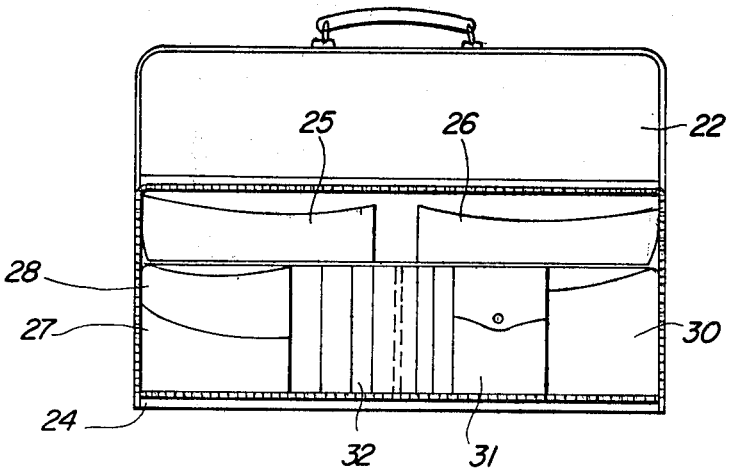
FIG. 3 is a front-elevational view of the carrying case shown in FIG. 1 with the front compartment thereof opened.

Referring to FIG. 3, upon arcuately opening front wall or cover 24, the compartment A side of common wall 22 is seen to include positioned thereon adjacent the top thereof a pair of elongate shallow pockets 25–26 adapted for retaining relatively long objects such as rulers, straight edges, etc. Lower on common wall 22 are a plurality of differing height, open-topped pockets 27, 28, 30, a snapably closable pocket 31, and a plurality of pencil/pen retaining slots 32. With this combination of multiple sized retaining pocket slots and closable pockets, a compartment A satisfies a traveler's need for a multiple purpose compartment for carrying business paraphenalia.

Figure 4:
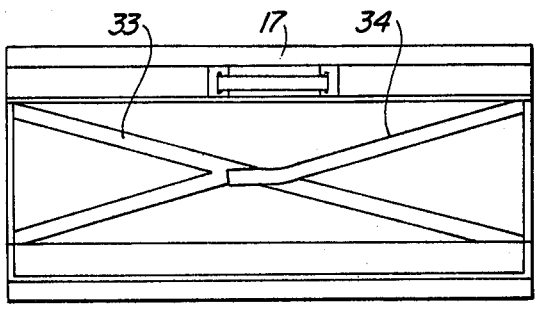
FIG. 4 is a top plan view of the carrying case of the present invention showing the center compartment thereof open.

Referring to FIGS. 1 and 4, with slide fastener unzipped such that compartment B is open, the largely hollow interior therof may be seen to be adapted for preferred carrying of clothing and/or personal care accessories. In this embodiment, a plurality of straps 33–34, preferably connectable by hook- and loop-type fasteners, may be utilized to maintain articles positioned in the carrying case as stored therein.

Figure 5:
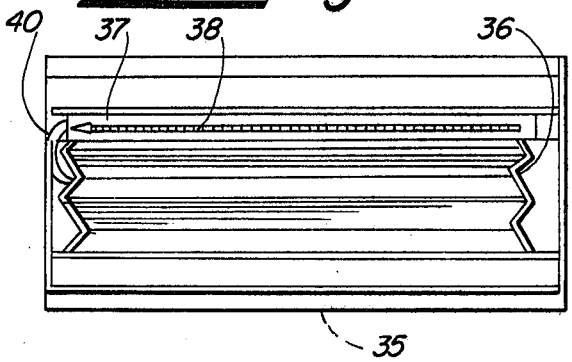
FIG. 5 is a top plan view of the carrying case showing the document storing compartment open and the umbrella storage pocket therein.
Figure 6:
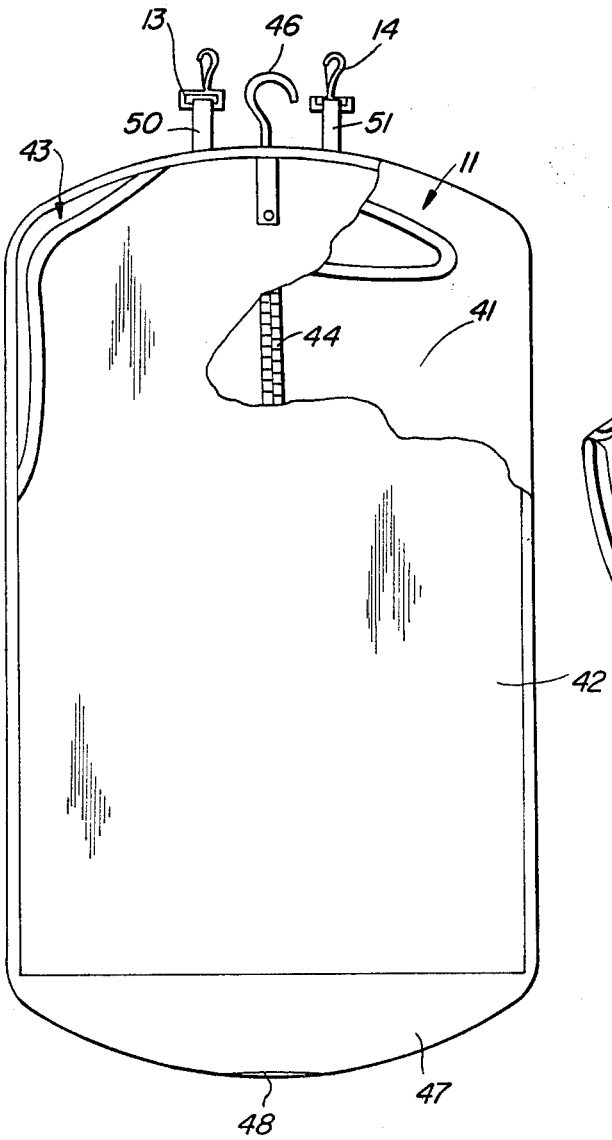
FIG. 6 is a rear elevational view of the improved garment bag of the present invention.

Referring to FIGS. 1 and 5, with the garment bag 11 disconnected from carrying case 12 and slide fastener 21 unzipped, the interior of compartment C is visible. When back outer wall 35 is moved arcuately outwardly, an accordian-style, multi-compartment file folder 36 is shown attached to common wall 23 between compartments B and C. Accordion file 36 provides for storage and separation of business documents as desired in a convenient and orderly manner.

Another aspect of the present invention is the provision of a tubular retainer 37 positioned at the top rear of compartment C and, in the preferred embodiment, attached to the common wall 23 above file folder 36. Tubular receptacle 37 includes a slide fastener 38 which may be opened to allow insertion and removal of a collapsible umbrella 40. With umbrella 40 packed out of the way in a convenient but accessible fixed position, carrying case 12 provides features not found in present day soft-sided luggage and travelware.

Referring to FIGS. 1, 2, 6, 7 and 8, the garment bag 11 of the present invention includes opposed elongate panels 41, 42 joined along their periphery either to each other or to an intermediate thin side strip 43 providing extra thickness to the garment carrier. The front panel 41 of garment carrier 11 includes an elongate opening with a slide fastener 44 attached thereto for providing selectable access to the garment carrier. A top opening 45 in the garment carrier allows the extension therethrough of a clothes hanger handle 46 in conventional manner. Another aspect of the present invention is the provision of an additional shoulder-type harness 47 attached to the bottom of garment carrier 11 adjacent the back side panel 42 thereof along its outer periphery. Harness 47 includes an open bottom defined by edge 49 extending laterally thereacross, and a plain top opening or collar 48 defined on one side or half thereof by the top of the perifery of the garment panel 42 and on the opposing side or half thereof by a middle segment of the periphery of harness 47 which is not joined to panel 42. The top of garment carrier 11 includes, in the preferred embodiment, a pair of snap fasteners 13–14 attached immediately adjacent the top opening 45 thereof by straps 50-51.

Figure 7:
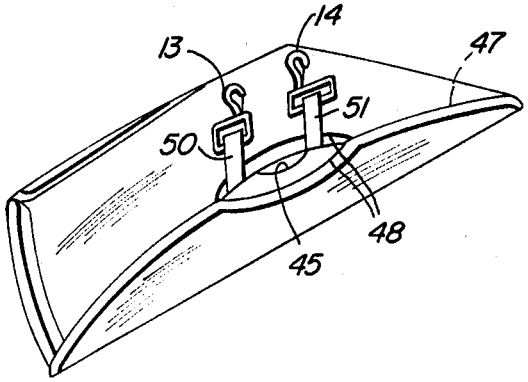
FIG. 7 is a perspective view of the garment bag shown in FIG. 6 as it appears with fasteners folded through retaining collar prior to fastening same to the carrying case.
Figure 8:
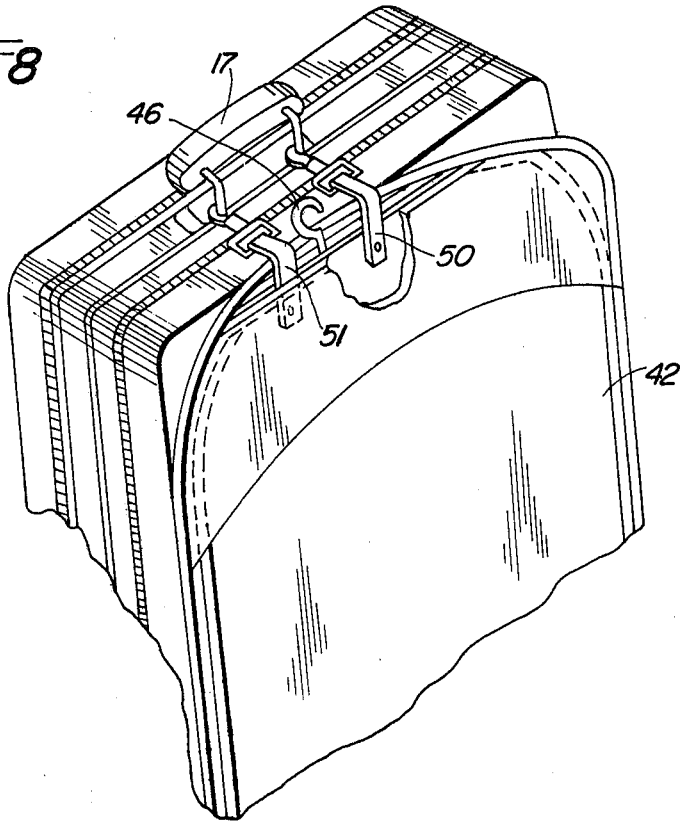
FIG. 8 is a fragmentary perspective view, with portions cut away, showing the shoulder type harness and connection between the carrying case and garment carrier.

As shown most clearly in FIGS. 7 and 8 with the garment carrier 11 folded in half, the upper portion thereof may be fitted into the opening between the bottom edge 49 of shoulder harness 47 which may be bowed to open wider as shown in FIG. 8 and the side of panel 42 such that the snap fasteners 13–14 and the straps 50–51 to which they are attached, respectively, extend through the collar or opening 48. In that position, the snap fasteners 13–14 may be connected to the hinge rings 15–16 of carrying case handle 17 to provide for convenient carrying of the garment bag with the carrying case by a user in one-handed fashion.

Thus, a new and unique combination garment carrier-carrying case has been shown and described. The carrying case may be made of differing materials including canvass, nylon, leather, vinyl, etc. and various forms of fastening and retaining means may be utilized to perform the functions described in the disclosure.

While one embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

The invention is claimed as follows:

1. In a carrying case of the type wherein flexible material is configured to define a plurality of generally rectangular polyhedral compartments having at least one of an opposed pair of spatially related sidewalls forming at least a portion of a common wall between adjacent compartments, and at least one panel forming a bottom, opposed end walls, and a top for each of said plurality of compartments, each compartment having an opening extending along the top and opposing sidewalls of same with closure means adjacent each opening, means on said case facilitating the carrying of same, and one of said compartments being a substantially hollow primary storage compartment, an improvement comprising:

a second compartment positioned adjacent said first compartment, said second compartment including file means mounted on said common wall between said first and second compartments for segregating any documents positioned in said case, a third compartment positioned adjacent said first compartment and opposite said second compartment, said third compartment including a plurality of storage compartments mounted on said common wall between said first and third compartments for storing equipment, small documents and the like; and umbrella storage means positioned in one of said second and third compartments for retention of a collapsible umbrella therein.

2. The carrying case as defined in claim 1 wherein said file means include a plurality of adjacent elongate pockets positioned to expand away from said common wall between said first and second compartments in accordian-like fashion.

3. The carrying case as defined in claim 1 wherein said umbrella storage means include a panel of pliable material defining a tubular structure, said tubular structure being mounted on said common wall in said compartment adjacent the top thereof for ease of user access.

4. The carrying case as defined in claim 3 wherein said umbrella storage means further include an elongate opening oriented longitudinally on said tubular structure and slide fastener means mounted adjacent thereto.

5. A combination carrying case and garment bag comprising:

a carrying case of the type wherein flexible material is configured to define a plurality of serially adjacent compartments sharing a common wall between each immediately adjacent compartment, an opening for each compartment and closure means adjacent each said opening, one of said compartments being a substantially hollow primary storage compartment, a second compartment positioned adjacent said first compartment and including file means therein mounted on a common wall between said primary compartment and said second compartment, and means on said carrying case for user portability of same, and a garment bag of the type having first and second panels of flexible material in juxtaposed position defining top and bottom ends of said bag and the periphery of said panels defining an outer border thereof, selectably closable access means on said bag, fastener means attached adjacent one of said top and bottom ends for fastening said garment bag to said carrying case and a harness or retainer attached adjacent the other of said top and bottom end at two spaced positions defining a neck opening therebetween through which said fastener means are insertable for maintaining said bag in a folded stable position when said garment bag is attached to said carrying case.

6. The combination as defined in claim 5 wherein said fastener means include elongate strap means terminating in clip means, said means for user portability include a handle hingedly attached to said carrying case, and said clip means being adapted for fastening on said handle.

* * * * *